United States Patent [19]

Opprecht

[11] 4,388,891

[45] Jun. 21, 1983

[54] APPARATUS FOR APPLYING A PROTECTIVE COATING TO THE WELDING OR SOLDER SEAM OF CAN BODIES

[76] Inventor: Paul Opprecht, Herrenbergstrasse 10, 8962 Bergdietikon, Switzerland

[21] Appl. No.: 302,207

[22] Filed: Sep. 14, 1981

[30] Foreign Application Priority Data

Oct. 7, 1980 [CH] Switzerland ..... 7479/80
Jul. 17, 1981 [CH] Switzerland ..... 4710/81

[51] Int. Cl.[3] ..... B05C 1/02; B05C 7/08

[52] U.S. Cl. ..... 118/215; 118/223; 118/221; 118/261

[58] Field of Search ..... 118/223, 224, 214, 215, 118/221, 211, 261

[56] References Cited

U.S. PATENT DOCUMENTS 2,097,428 11/1937 Bergstein ..... 118/221 X
2,191,149 2/1940 Wright ..... 118/221
3,980,514 9/1976 Rosette et al. ..... 118/261 X
4,249,476 2/1981 Opprecht et al. ..... 118/215 X

*Primary Examiner*—John P. McIntosh
*Attorney, Agent, or Firm*—Werner W. Kleeman

[57] ABSTRACT

An apparatus for the application of a protective coating to the welded or soldered seam of can bodies. Two driven rolls arranged in tandem or series apply a protective coating, typically in the form of a lacquer, to the seam of the cans or can bodies. One of the rolls covers the actual seam and the other roll covers the region neighboring the seam. Both effective regions of the rolls overlap laterally of the seam at critical locations where the protective coating is to be applied to the seams of the can.

14 Claims, 7 Drawing Figures

APPARATUS FOR APPLYING A PROTECTIVE COATING TO THE WELDING OR SOLDER SEAM OF CAN BODIES

BACKGROUND OF THE INVENTION

The present invention relates to a new and improved construction of apparatus for the application of a protective coating to the welded or soldered seam of can bodies, sometimes simply referred to herein as cans.

Generally speaking, the apparatus for applying such protective coating comprises driven rolls which are located internally of the can bodies moving past such rolls and which partially immerse in a protective coating or covering mass, typically a suitable lacquer or varnish. These applicator rolls serve for applying the protective coating or covering mass to the inner surface of the seam of the cans.

According to a prior art apparatus, for instance as disclosed in German Patent Publication No. 2,728,741, a protective covering or coating mass is applied by the circumferential or peripheral surface of a roll, immersible in the coating mass, onto the welded or soldered seam. According to another design of this prior art equipment there are provided two identical rolls arranged in series or tandem.

With the state-of-the-art apparatus it is possible to obtain a qualitatively adequate covering of the seam with the coating mass. Yet, it is difficult to optimumly accommodate the distribution of the coating mass transverse to the seam so as to take into account the momentarily prevailing requirements and conditions which are encountered when seam coating cans or the like.

SUMMARY OF THE INVENTION

Therefore, with the foregoing in mind it is a primary object of the present invention to provide a new and improved construction of apparatus for the application of a protective coating to the welded seam of a can body or the like, in a manner which is not afflicted with the aforementioned drawbacks and limitations of the prior art proposals.

Another and more specific object of the present invention aims at providing a new and improved construction of apparatus for the application of a protective coating to the welded or soldered seam of can bodies in a manner enabling a uniform application of the coating mass along the seam, especially also at the start and end of the seam, wherein however it is also possible to accommodate the coating mass in a direction transverse to the seam, i.e. especially to correlate the thickness of the coating mass to the encountered requirements, such as the nature of the contents of the cans which are to filled, the shelf life of such filled cans and so forth.

Still a further significant object of the present invention is directed to a new and improved construction of apparatus for the application of a protective coating to a seam of a can body or the like in an extremely reliable, efficient and protective manner, and which apparatus is relatively simple in construction and design, extremely reliable in operation, not readily subject to breakdown or malfunction, and requires a minimum of maintenance and servicing.

A further significant object of the present invention aims at the provision of an apparatus for applying a protective coating to an article wherein the applied coating mass, particularly if the same is a protective coating formed on a dual-component basis, is continuously circulated or placed in agitation in order to prevent premature setting or solidification of the protective coating within its container.

Now in order to implement these and still further objects of the invention, which will become more readily apparent as the description proceeds, the apparatus for applying a protective coating to the welded or soldered seams of a can body or the like, is manifested by the features that the application of such protective coating or coating mass is accomplished by the peripheral or circumferential surfaces of two tandemly arranged rolls which are immersed in a common container for the protective coating, typically a lacquer. The first applicator roll or roller is narrower than the second applicator roll or roller and the central region of the seam is covered with the lacquer. The periphery of the second applicator roll possesses means structuring the same such that application of the lacquer at the region of the seam is precluded. As to the second applicator roll such coating mass-precluding means may be in the form of a recessed portion or equivalent structure.

With the invention it is advantageously possible to apply the coating mass in a dosed quantity over the cross-section of the seam and its neighboring regions.

A further beneficial aspect of the invention resides in the capability of applying a larger quantity of the lacquer or protective coating to the seam.

An additional benefit which is realized with the invention resides in the fact that by virture of the exact controllability or regulatability of the peripheral speed of the applicator rolls by means of an independent internally situated drive it is possible to obtain at the start and end of the seam an outstanding covering of the seam regions which are to be protected.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a longitudinal sectional view through an exemplary embodiment of apparatus for applying a protective coating to the seam of a can body or the like;

DETAILED DESCRIPTION OF THE PREFERRED EMBODIMENTS

Figure 1:
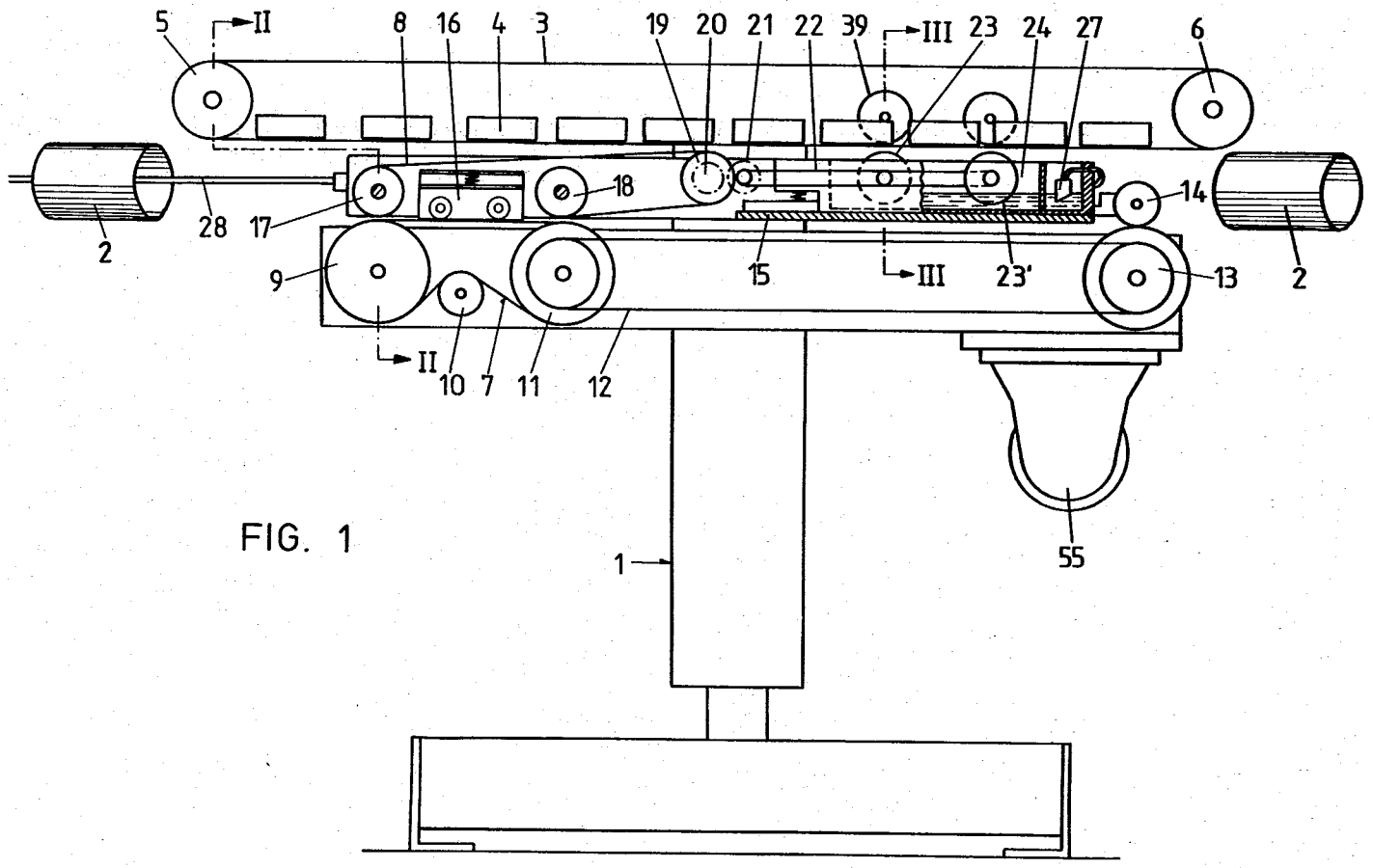
Figure 2:
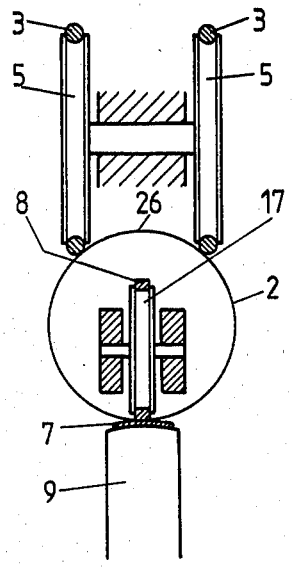
FIG. 2 is a cross-sectional view through the conveyor or feed device for the can bodies, the section being taken substantially along the line II—II of FIG. 1.
Figure 3:
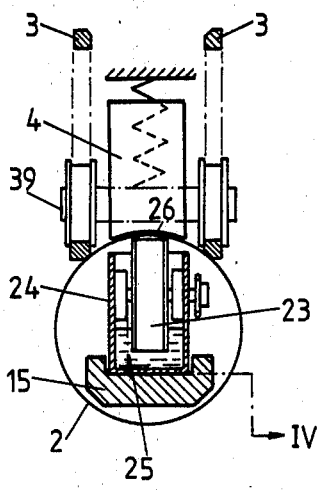
FIG. 3 is a sectional view through the protective coating or lacquer container of the arrangement of FIG. 1, the section being taken substantially along the line III—III thereof.

Describing now the drawings, it is to be understood that only enough of the construction of the apparatus for applying a protective coating to the welded or soldered seam—herein broadly simply sometimes referred to as seam—of a can body or the like has been shown therein as will enable those skilled in this technology to readily comprehend the underlying and important principles and concepts of the present invention. Turning attention to FIG. 1, there is shown therein in longitudinal sectional view the entire protective coating-applicator apparatus used for applying a suitable protective coating, typically a lacquer protective coating, to the can bodies. The lacquer applicator apparatus will be seen to comprise a support or frame structure 1. The can bodies, generally indicated by reference character 2, which are to have applied thereto the protective lacquer coating, arrive from a not particularly illustrated but conventional welding machine at the lacquer applicator apparatus of the invention as shown in FIG. 1. So that the welding seam of the can bodies 2 remains exactly in desired position, the can bodies 2, after the welding operation has been completed, are either laterally guided by means of two magnetic tapes or similar transport means of conventional design and therefore here not further shown, particularly since such does not constitute subject matter of the present invention, until they arrive at the lacquer applying apparatus or these can bodies are conveyed from the welding station up to and through the lacquer applicator apparatus by means of the belts 3, shown particularly well in FIGS. 2 and 3. These transport belts 3 can possess a circular cross-sectional configuration, as shown in FIG. 2, or can have a multi-edge or multi-cornered configuration, as shown in FIG. 3. The magnets 4 or equivalent can retention elements which are arranged above the can bodies 2 serve to maintain these can bodies 2 in fixed contact with the belts 3. The belts 3 travel over rolls 5 and 6 arranged in related pairs, and the drive of the belts 3 can be accomplished by driving one of the pairs of rolls, either the roll pair 5 or the roll pair 6, by any suitable drive motor. As to this portion of the equipment design reference may be also had to the commonly assigned U.S. Pat. No. 4,249,476, granted Feb. 10, 1981.

Continuing, by means of a flat belt 7 there is driven a profile belt 8 arranged above the flat belt 7 and extending essentially in parallellism therewith. The flat belt 7 is guided over the rolls 9, 10 and 11. The guide roll 11 is driven by means of a belt 12 or equivalent power transmitting element from a roll or roller 13. Any suitable drive motor 55 serves to drive the roll 13. A lacquer applicator unit 15 is supported by a roll 14 upon the roll 13. The transport or feed velocities of the circular or round belts 3 and flat belt 7 are the same.

The lacquer applicator or applying unit 15 together with the belt drive or profile belt 8 are resiliently supported upon the flat belt 7. In this way there is ensured that the belt 8 also then will be driven by the flat belt 7 whenever a can body 2 passes this portion of the lacquer or protective coating applying apparatus. The resilient pressing or contact of the profile belt 8 against the flat belt 7 is accomplished by means of the press or contact means 16. The profile belt 8 is guided over the guide rolls 17, 18 and 19. At the guide roll 19 there is located a concentrically arranged gear 20 which meshes with a gear 21. A chain 22 or equivalent structure arranged at the gear 21 drives the lacquer or protective coating applicator rolls 23 and 23', sometimes simply referred to as applicator rolls or lacquer applicator rolls.

Now in FIG. 2 there has been illustrated in cross-sectional view the device for conveying the can bodies 2 and also the drive of the profile belt 8 by means of the flat belt 7.

Figure 4:
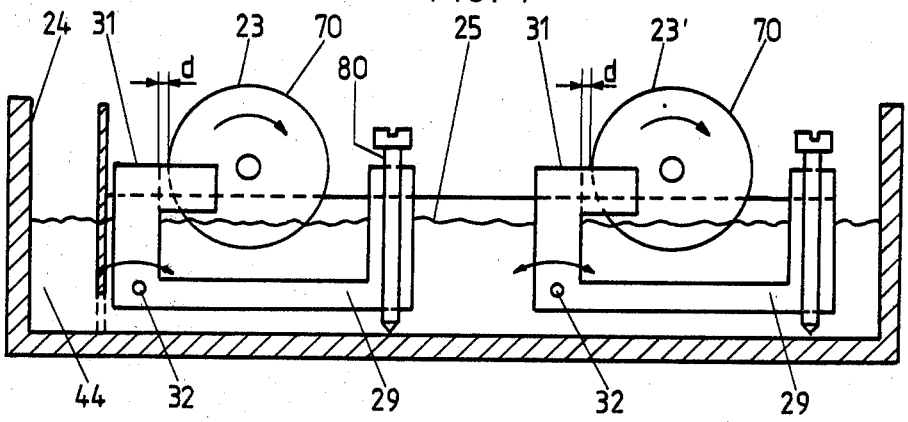
FIG. 4 is a longitudinal sectional view through a lacquer container constructed according to the invention.

FIG. 3 is a cross-sectional view through the lacquer container 24 and the applicator roll 23. By means of the applicator roll 23 the protective coating, which it will be recalled is a suitable lacquer which may be of the type disclosed in the aforementioned U.S. Pat. No. 4,249,476, is conveyed out of the lacquer bath 25 and applied to the inner surface or side of the welding or welded seam 26 of the can bodies 2. The applicator roll 23 is preferably fabricated from a material which ensures for good entrainment of the lacquer or the like which is to be applied to the seams of the can bodies 2. By means of a feeler or sensor head 27 or equivalent lacquer bathsensing means, it is possible to regulate by the action of a suitable level control the level of the lacquer bath 25 from externally of the lacquer applicator apparatus. The infeed of the lacquer is accomplished by means of the infeed line 28 to a pre-chamber or chamber portion 44 of the lacquer container 24, as will be recognized from FIG. 1 and also FIG. 4. The lacquer level also can be of course adjusted and regulated by other arrangements, such as a self-regulating apparatus which is dependent upon the force of gravity or by an optical sensor device. By means of the lacquer infeed line or conduit 28 or another suitable connection element the lacquer applying apparatus is operatively connected with the welding machine and safeguarded from carrying out undesired axial displacements or shifting movements.

The drive of the applicator rolls 23 and 23' by means of the profile belt 8 and the chain 22 must be accomplished within the cylinder which is formed by the throughpassing can bodies 2.

In the description to follow there will be explained, based upon the illustrations of FIGS. 4 to 8, the lacquer applying operation as well as details of the actual lacquer applicator unit or device 15. According to a first exemplary embodiment there are arranged within the lacquer container 24 opposite the applicator roll 23 and the additional applicator roll 23' the related scraper devices 29. These scraper devices or scraper means 29 can be composed, for instance of a respective body 31 which partially encloses the related applicator roll 23 and 23'. Each such scraper body 31 possesses a small however fixed spacing from the end surfaces of the applicator rolls 23 and 23', as best seen by referring to FIG. 5, and the spacing d of the scraper body 31 from the periphery of the related applicator roll 23 and 23' can be adjusted in any suitable manner. To this end, each scraper body 31 is mounted to be pivotable about a substantially horizontal shaft 32 and can be positionally adjusted by a suitable adjustment screw 80 or equivalent adjustment means. Hence, lowering of the scraper body 31 reduces the spacing or distance d and, thus, also reduces the quantity of lacquer which is located at the periphery of the applicator rolls 23 and 23' and which is to be applied to the can seam.

Figure 5:
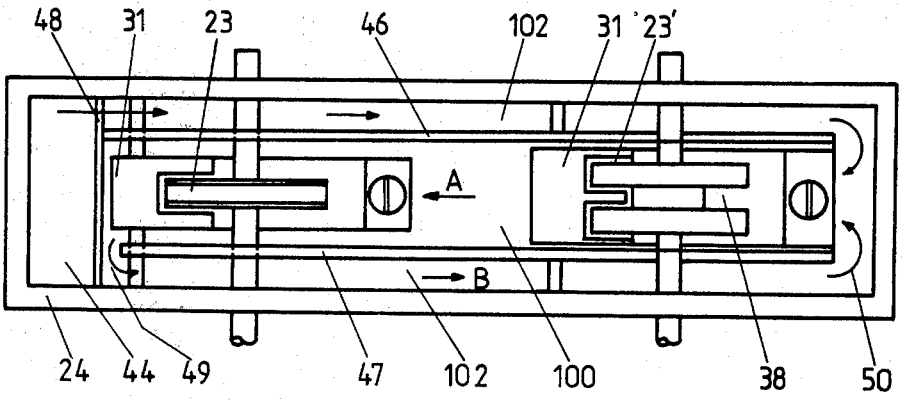
FIG. 5 is a top plan view of the lacquer container shown in FIG. 4.

In FIG. 5 there is shown in top plan view the lacquer container 24 while omitting the drive means for the applicator rolls 23 and 23' and other parts which are unnecessary for purposes of understanding the subject matter of the instant invention. It is to be understood however that any other suitable drive means can be used for driving the driven applicator rolls 23 and 23' which may be constructed so as to have a rough surface, as simply generally represented by reference character 70 in FIG. 4. Thus, conceptually element 22 may be construed as a drive motor, for instance of the adjustable rotational speed type, for directly driving the applicator rolls 23 and 23'. The first applicator roll 23 is arranged in conventional manner. The second applicator roll 23' is located in spaced relationship from the first applicator roll 23. Both of the roll parts or regions 34 located laterally of the recessed portion or recess means 38 of the second applicator roll 23' are arranged such that by the action of the applicator roll 23 lacquer is predominantly applied to the can seam 26, and by the action of the second applicator roll 23' lacquer is applied to the regions laterally of the can seam.

Figure 6:
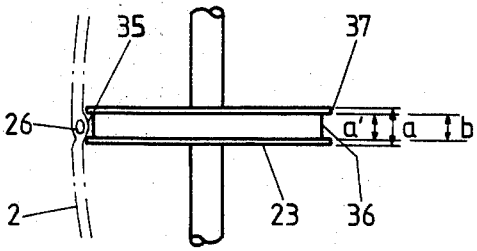
FIG. 6 is a front view of the first applicator roll for applying the protective coating.
Figure 7:
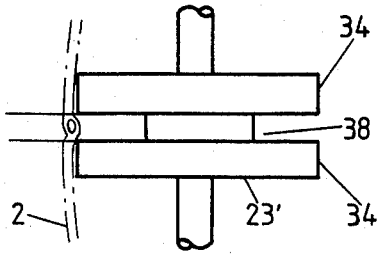
FIG. 7 is a front view of the second applicator roll for applying the protective coating.

Advantageously, the working or effective regions of both of the applicator rolls 23 and 23' overlap in a manner such that the most sensitive part of the seam 26, namely the edge 35 is coated twice with the protective coating or lacquer, as will be best recognized by inspecting FIGS. 6 and 7. In particular, from the showing of FIG. 6 there will be apparent the recess means 36 at the roll periphery of the first applicator roll 23 into which protrudes the welded seam 26. Both of the lateral webs or side plates 37 of the applicator roll 23 possess, in relation to the width a' of the recess 36, a smaller width and predominantly have assigned thereto the task of preventing the central portion of the roll periphery from bearing against the seam 26, and thus ensuring for a sufficiently great intensity or thickness of the lacquer coating. The deeper recess 38 of the second applicator roll 23' possesses a width b which is smaller than the width a of the first applicator roll 23, so that the regions of the roll webs or side plates 37 and 34 positively overlap one another, as will be seen by comparing FIGS. 6 and 7.

In order to ensure for a constant uniform contact of the can bodies 2 at the applicator rolls 23 and 23', independent of possibly prevailing fluctuations in the thickness of the sheet metal from which the can bodies are formed or independent of other encountered irregularities in the can bodies, there are provided spring-loaded adjustable counter pressure roll pairs 39 above the applicator rolls 23 and 23', as will be evident by referring to FIGS. 1 and 3. These counter pressure rolls 39 act upon the belts 3 which feed the cans 2 along the lacquer applicator apparatus and press the can bodies 2 uniformly against the applicator rolls 23 and 23'. Of course, it is also possible to press directly upon the outer surfaces of the cans 2 from the outside by means of spring-loaded or resiliently biased counter pressure rolls, at the region of the applicator rolls 23 and 23'. The peripheral portions of the counter pressure rolls 39 preferably possess the same curvature as the cans or can bodies 2.

Additionally, it has been found to be advantageous to structure the counter pressure rolls 39 and their suspension so as to possess as low as possible mass, in order to thereby obtain a constant contact or pressing action between the lacquer applicator rolls 23, 23' and the cans or can bodies 2. An adjustable stop (not shown) prevents the downward shifting of the counter pressure rolls 39 at those times when no can or can body 2 is passing through the equipment.

Of course, it is also possible to drive the driven applicator rolls 23 and 23' by means of a shaft extending parallel to the lacquer infeed line 28 and protruding through the interior of the cans 2 or to use a very small drive motor which can be installed directly at the lacquer container or vat 24, without departing in any way from the underlying principles and teachings of the invention.

If there is employed a drive motor which is mounted at the lacquer container 24, for instance in the form of an air, hydraulic or electric motor, it is possible, in contrast to the above-described drive arrangement, to additionally adjust and regulate the rotational speed of the applicator rolls 23 and 23' at any time from the outside and independently of the travel speed or velocity of the can bodies 2. This particularly affords a coordination or accommodation of the application of the protective coating or lacquer at the start and end of the cans.

At this point it is underscored that a further appreciable aspect of the invention resides in the circulation of the protective coating or lacquer within the supply container or vat 24, especially when using a dual-component protective coating or the like. To that end it will be seen that laterally of the both of the applicator rolls 23 and 23' there is provided a respective partition or separation wall 46 and 47, which divides the interior of the lacquer container 24 into three zones or regions 100, 102, which extend essentially lengthwise of the lacquer container 24. These zones 100, 102 may be considered as constituting an intermediate zone 100 straddled by the two outer zones or regions 102, as best seen by referring to FIG. 5. Additionally, it will be recognized that the partition wall 47 forms a gap 49 between the wall 48 forming the pre-chamber 44 of the supply container 24. At the side of the container 24 located opposite the pre-chamber or region 44 the partition walls 46 and 47 leave free a circulation gap 50, as also best seen by referring to FIG. 5.

By virtue of the rotating applicator rolls 23 and 23' which are immersed in the lacquer bath 25 lacquer is placed into movement in the direction of the arrow A, i.e., through the intermediate zone 100. The lacquer then can escape through the gap 49 out of the intermediate region or zone 100 of the lacquer supply container 24 and can flow back without any disturbance at the outer regions or zones 102 in the direction of the arrow B of FIG. 5. By virtue of the circulation gap 50 the circulated or agitated lacquer as well as any new or replenishing lacquer can flow out of the pre-chamber 44 back into the central region or zone 100 containing the applicator rolls 23 and 23'.

With the aid of a suitable level feeler or scanner device, like the feeler 27 of the arrangement of FIG. 1, which is provided in the pre-chamber or space 44 it is possible to regulate the infeed of the new or replenishing lacquer or the like and thus there can be maintained constant the lacquer level within the supply container 24. Furthermore, the supply line 28 for the protective coating or lacquer can open into the prechamber 44 of the supply container 24 or into one of the outer or lateral zones 102.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for the application of a protective coating to a seam, such as a welded or soldered seam, of can bodies, comprising:

means for supplying the protective coating for application as a coating mass to the inside of the seam;

at least two driven rolls defining a first applicator roll and a second applicator roll at least partially immersible in the coating mass furnished by said supplying means;

said driven applicator rolls applying the coating mass to the inside of the seam;

said supplying means comprising a common container for the protective coating;

said two applicator rolls being arranged in tandem within said common container;

said first applicator roll being structured to be narrower than said second applicator roll and serving to cover a central region of said seam with said protective coating; and said second applicator roll having a peripheral portion containing means which preclude application of the protective coating at the region of said seam.

2. The apparatus as defined in claim 1, wherein:

said means of said second applicator roll comprises recess means which precludes application of the protective coating at the region of the seam.

3. The apparatus as defined in claim 2, wherein:

the width of said recess means of said second applicator roll is smaller than the width of the first applicator roll.

4. The apparatus as defined in claim 2, wherein:

said second applicator roll comprises two roll portions arranged at an axial spacing from one another.

5. The apparatus as defined in claim 4, wherein:

said two roll portions contain therebetween said recess means.

6. The apparatus as defined in claim 4, wherein:

said first applicator roll is provided with recess means at the region of the seam for receiving a greater quantity of the protective coating than at lateral regions of said first applicator roll.

7. The apparatus as defined in claim 1, wherein:

each of said applicator rolls have peripheral portions structured as a rough surface.

8. The apparatus as defined in claim 1, further including:

respective scraper means provided for each of said applicator rolls for regulating the thickness of the applied protective coating.

9. The apparatus as defined in claim 1, further including:

drive means for driving said applicator rolls directly at an adjustable rotational speed.

10. The apparatus as defined in claim 9, wherein:

said drive means comprises a drive motor for directly driving each of the applicator rolls.

11. The apparatus as defined in claim 1, further including:

partition walls arranged laterally of said applicator rolls and extending approximately over the entire length of the container;

said partition walls dividing the container into three zones defined by an intermediate zone and two lateral zones straddling said intermediate zone; and said applicator rolls conveying the protective coating at the intermediate zone in a predetermined direction and following deflection of the conveyed protective coating at an end portion of the container said protective coating flows back towards an opposite end of said container at least through one of said lateral zones.

12. The apparatus as defined in claim 11, further including:

means for infeeding replenishing lacquer to the container at a location of one of the lateral zones.

13. The apparatus as defined in claim 12, further including:

means providing a pre-chamber at an end region of the container; and means for infeeding replenishing lacquer to said pre-chamber.

14. The apparatus as defined in claim 1, wherein:

said first applicator roll first applying the protective coating to the can seam; and said second applicator roll then applying the protective coating to regions of the can body located laterally adjacent the can seam.

* * * * *